US007131450B2

(12) United States Patent
Fujita

(10) Patent No.: US 7,131,450 B2
(45) Date of Patent: Nov. 7, 2006

(54) METHOD FOR WASHING A SAMPLE TUBE AND ITS WASHING APPARATUS

(76) Inventor: Yuukou Fujita, 24-9, Senriyamatakatsuka, Suita-shi Osaka-fu (JP) 565-0848

( * ) Notice: Subject to any disclaimer, the term of this patent is extended or adjusted under 35 U.S.C. 154(b) by 307 days.

(21) Appl. No.: 10/739,444

(22) Filed: Dec. 17, 2003

(65) Prior Publication Data

US 2005/0051192 A1 Mar. 10, 2005

(30) Foreign Application Priority Data

Sep. 8, 2003 (JP) ..... 2003-314872

(51) Int. Cl.
*B08B 9/08* (2006.01)
*B08B 9/20* (2006.01)

(52) U.S. Cl. ..... 134/170; 134/104.2; 134/166 C; 134/169 C

(58) Field of Classification Search ..... 134/170, 134/166 C, 104.2, 169 C
See application file for complete search history.

(56) References Cited

U.S. PATENT DOCUMENTS 4,310,010 A * 1/1982 Svoboda ..... 134/135
4,354,514 A * 10/1982 Sundheimer et al. ..... 134/152

FOREIGN PATENT DOCUMENTS

| | | |
|---|---|---|
| JP | 62-62883 | 4/1987 |
| JP | 5-208177 | 8/1993 |
| JP | 2826997 | 9/1998 |
| JP | 2003-53287 | 2/2003 |

* cited by examiner

*Primary Examiner*—Michael Barr
*Assistant Examiner*—Saeed Chaudhry
(74) *Attorney, Agent, or Firm*—Jordan and Hamburg LLP

(57) ABSTRACT

A sample tube is washed by inserting a suction tube from an open end of the sample tube having a closed end, and circulating washing liquid supplied from an upper side of the closed end of the sample tube over an exterior and in an interior of the sample tube to suck and discharge the liquid through the suction tube. The sample tube is washed by providing a holder for holding the sample tube in a manner that the open end of the sample tube having a closed end, the suction tube of which upper end side is inserted to the sample tube and of which lower end side is supported by the holder, and a washing liquid receiving tube arranged around the sample tube, and by circulating the washing liquid supplied from the upper side of the closed portion of the sample tube over the exterior and in the interior of the sample tube to suck and discharge the liquid through the suction tube. On the other hand, the sample tube is dried by circulating air over the exterior and in the interior of the sample tube after the washing.

2 Claims, 8 Drawing Sheets

(2)

(1)

METHOD FOR WASHING A SAMPLE TUBE AND ITS WASHING APPARATUS

BACKGROUND OF THE INVENTION

1. Field of the Invention

The invention relates to a method for washing a test tube for washing and drying a sample tube (glass test tube), such as an NMR (nuclear magnetic resonance) tube used in a laboratory (research institute) of colleges, hospitals, and various plants.

2. Description of the Related Art

In a prior art, blowing-type washing is performed, wherein an interior of a test tube is washed by blowing washing liquid from a nozzle into the interior of a sample tube (test tube) standing upside down. In another prior art, an interior of a glass tube is washed by supplying washing liquid from a nozzle into the interior of the tube formed in unit length. (For example, patent reference 1: Publication Number H5-208177)

SUMMARY OF THE INVENTION

In the blowing-type washing according to the prior arts, there are problems that, since a sample tube is washed by blowing washing liquid against a bottom of the sample tube, it is necessary to install a cover or the like to an upper side of the sample tube to prevent the sample tube from being displaced; as for a glass tube formed in unit length, a structure is complicated because the glass tube is washed and dried in a manner that both ends of the glass tube are held between a supply side nozzle and discharge side nozzle for the washing liquid or air; and in either of these cases, contact of the tube with an instrument may result in damage to the tube, and only the interior of the tube can be washed.

In the present invention, a sample tube is washed by inserting a suction tube from an open end of the sample tube having a closed end and circulating washing liquid supplied from an upper side of the closed portion of the sample tube over an exterior and in an interior of the sample tube to suck and discharge the liquid through a suction tube.

Moreover, the sample tube is dried by circulating air over the exterior and in the interior of the sample tube through the suction tube after washing the sample tube with washing liquid.

The sample tube is washed by providing a holder for holding the sample tube in a manner that an open end of the sample tube having a closed end is directed downward, a suction tube of which upper end is inserted into the sample tube and of which lower end is held by the holder, and a washing liquid receiver installed to an exterior of the sample tube, and by circulating the washing liquid supplied from the upper side of the closed portion of the sample tube over the exterior and in the interior of the sample tube to suck and discharge the liquid through the suction tube. On the other hand, the sample tube is dried by circulating air over the exterior and in the interior of the sample tube through the suction tube after the washing.

A suction hole for circulating air in a middle portion of the holder from an upper side to a lower side is formed, the suction tube is connected to the suction hole communicably, and a top of the holder in contact with the open end of the sample tube is provided with a communicating groove for connecting the interior and exterior of the sample tube communicably.

The sample tube, the suction tube, the holder, and the receiving tube are provided separately from each other.

Therefore, according to the present invention, the suction tube is inserted from the open end of the sample tube having a closed end, washing liquid supplied from the top of the closed end of the sample tube is circulated over the exterior and in the interior of the sample tube, and the liquid is sucked and discharged through the suction tube in order to wash the sample tube. Thus, it is possible to wash the sample tube uniformly and without fail with washing liquid circulating over the exterior and in the interior of the sample tube and to wash the sample tube in an exceptional manner without external pressure acting on the sample tube in order to prevent damage to even an extremely thin-walled tube.

It is possible, after washing the sample tube with the washing liquid, to dry the sample tube by circulating air over the exterior and in the interior of the sample tube through the suction tube and to dry the exterior and interior of the sample tube in an excellent and rapid manner by automatically sucking air by the suction tube, for example, after the washing liquid is used up.

The sample tube is washed by providing the holder for holding the sample tube in a manner that an open end of the sample tube having the closed end is directed downward, the suction tube of which the upper end is inserted into the sample tube and of which the lower end is held by the holder, and the washing liquid receiver is installed to the exterior of the sample tube, and by circulating the washing liquid supplied from the top of the closed portion of the sample tube over the exterior and in the interior of the sample tube to suck and discharge the liquid through the suction tube. On the other hand, the sample tube is dried by circulating air over the exterior and in the interior of the sample tube through the suction tube after the washing. Thus, the sample tube is washed and dried by circulating the washing liquid and air over the exterior and in the interior of the sample tube in an excellent manner. Moreover, it is possible to wash and dry the sample tube by keeping the sample tube in a proper position capable of preventing damage to the sample tube in a condition that a lower end of the sample tube is sucked and held on the top of the holder by sucking force of the suction tube during the washing and drying work.

A suction hole for circulating air in the middle portion of the holder from the upper side to the lower side is formed, the suction tube is connected to the suction hole communicably, and the top of the holder in contact with the open end of the sample tube is provided with the communicating groove for connecting the interior and exterior of the sample tube communicably. Thus, it is possible to hold the sample tube on the top of the holder in a constant standing condition without fail and to wash and dry always in a stable condition by circulating a proper amount of the washing liquid and air from the exterior to the interior of the sample tube through the communicating groove.

The sample tube, the suction tube, the holder, and the receiving tube are provided separately from each other. Thus, even in a case that, for example, the sample tube is changed to one different in size or length as required, it is possible to change the suction tube, the holder, and the receiving tube corresponding to the size or length of the sample tube and thus to easily wash and dry various types of sample tube using a single washing apparatus.

4 Sample tube
4*b* Open end
10 Holder
11 Suction hole
13 Suction tube
14 Receiving tube
21 Communicating groove

DESCRIPTION OF THE PREFERRED EMBODIMENTS

The embodiments of the present invention are described in detail using drawings.

Figure 1:
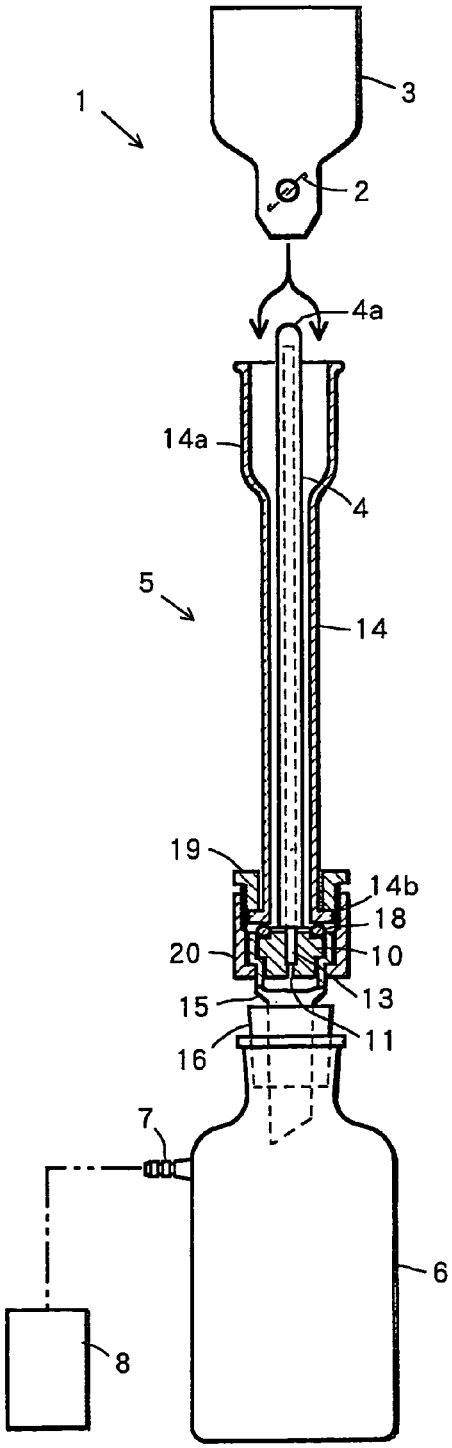
FIG. 1 is a schematic side view of a washing apparatus.
Figure 2:
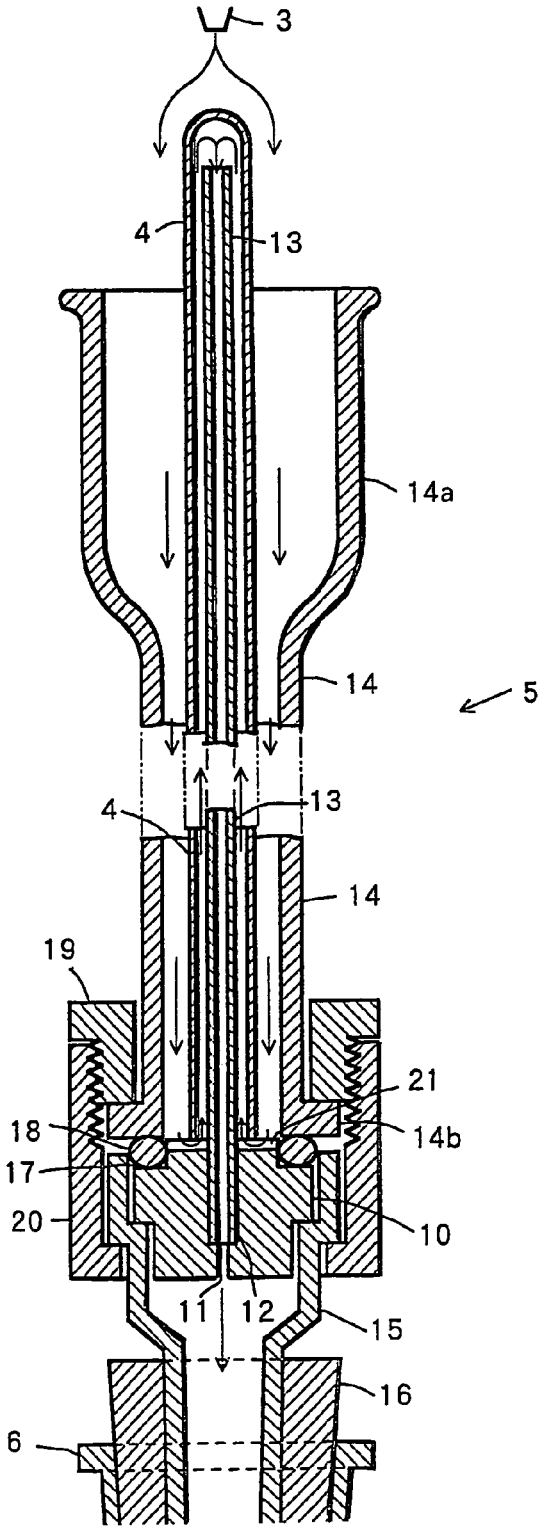
FIG. 2 is a cross-sectional view explaining a washing portion.

FIG. 1 is a schematic side view of an apparatus for washing a sample tube made of glass, and FIG. 2 is a cross-sectional view explaining the same, wherein washing apparatus 1 comprises a washing liquid supplying container 3 having a cock 2, a washing portion 5 for washing with washing liquid A a sample tube 4 made of glass and having a bottom, such as an NMR (nuclear magnetic resonance) tube arranged below the supplying container 3, a discharged liquid container 6 for reserving the washing liquid A installed under the washing portion 5, and a suction apparatus 8, such as an aspirator or a vacuum pump connected to a siphon hole 7 at an upper portion of the discharged liquid container 6.

Figure 3:
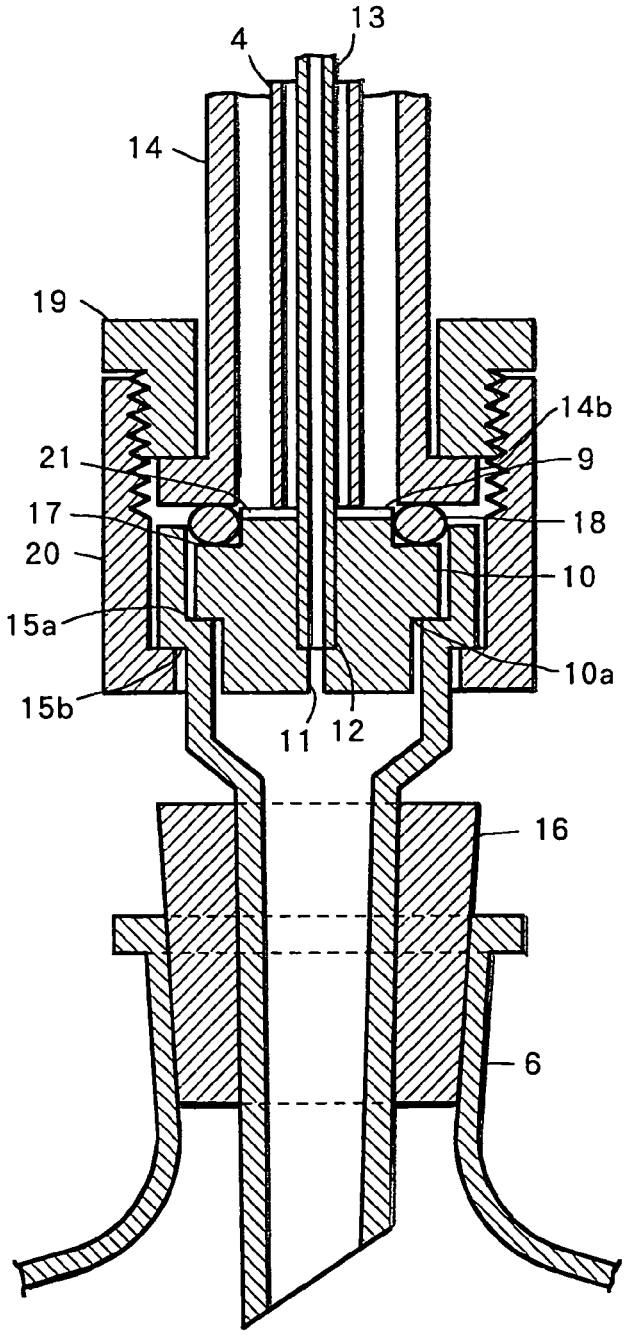
FIG. 3 is a view explaining a sample tube mounting portion.
Figure 4:
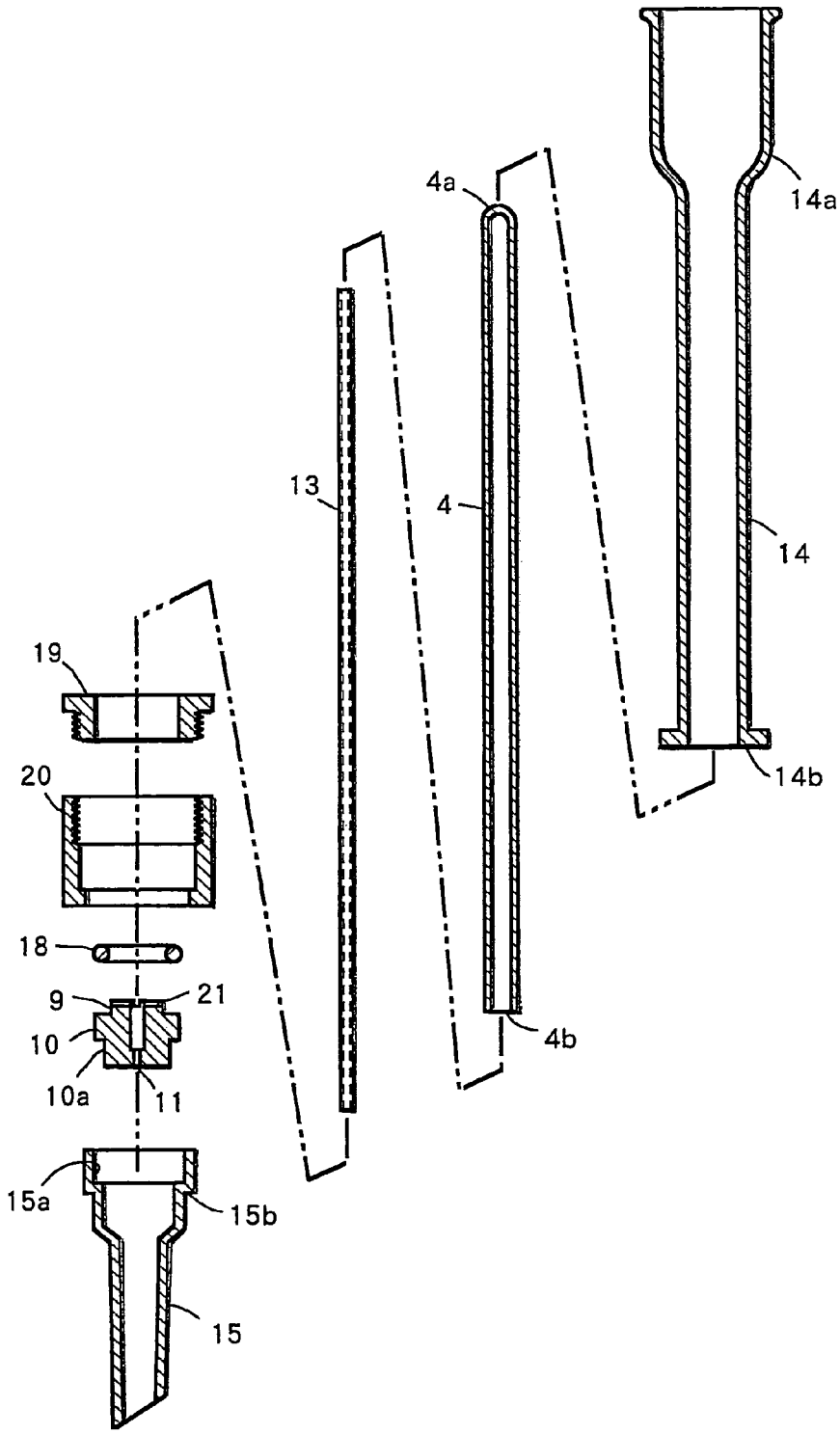
FIG. 4 is an exploded view explaining the washing portion.

As shown in FIG. 3 and FIG. 4, the aforementioned washing portion 5 comprises:

a holder 10 almost cylindrical and made of synthetic resin for holding a sample tube 4 on an upper side disk portion 9 in an upside down posture in a manner that a bottom 4*a* of the sample tube 4 is positioned in an upper side and an open end 4*b* in a lower side;

a suction tube 13 made of small diameter stainless steel pipe, wherein an upper end of the tube is inserted close to a bottom of the sample tube 4 and a lower end is inserted to and supported by an upper fitting hole 12 having a diameter larger than that of a suction hole 11 at a middle of the holder 10;

a receiving tube 14 forming a funnel portion 14*a* having a large diameter on a top of the receiving tube arranged around the sample tube 4;

a siphon tube 15, of which an engaging shoulder portion 15*a* at an inside periphery of an upper end of the siphon tube 15 is fitted to an outside periphery of the holder 10 and a lower outer shoulder portion 10*a*, and of which a lower end is penetrated in a rubber plug 16 for tightly closing an opening of the discharged liquid container 6;

an O-ring 18 installed between an O-ring groove 17 at an outside periphery of the disk portion 9 of the holder 10 and a flange portion 14*b* at the lower end of the receiving tube 14; and upper and lower connectors 19 and 20 of thread-connecting bush and socket types, wherein the flange portion 14*b* of the receiving tube 14 and an outer shoulder portion 15*b* of a siphon tube 15 are pressed vertically to press the O-ring between the receiving tube 14 and the holder 10.

The receiving tube 14 is tightly connected to the holder 10 through the O-ring 18 when the upper and lower connectors 19 and 20 are thread-connected. Moreover, the holder 10, the receiving tube 14, the suction tube 13, the siphon tube 15, and the sample tube 4 are composed in a separable manner when the upper and lower connectors 19 and 20 are disengaged.

Figure 5:
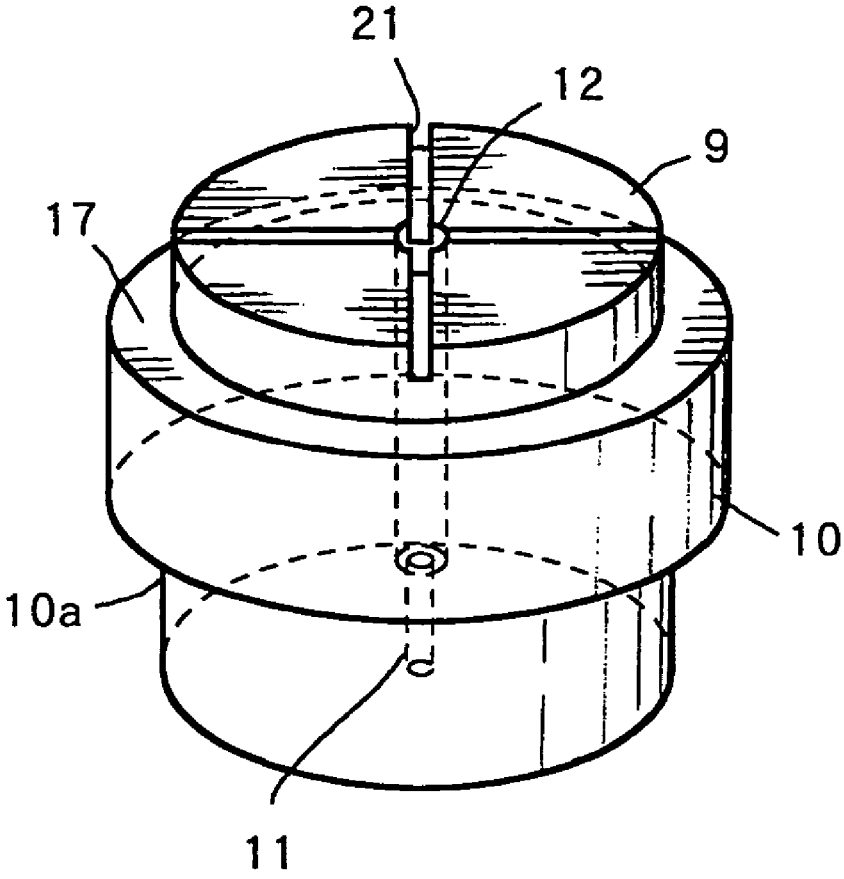
FIG. 5 is a perspective view explaining a holder.
Figure 6:
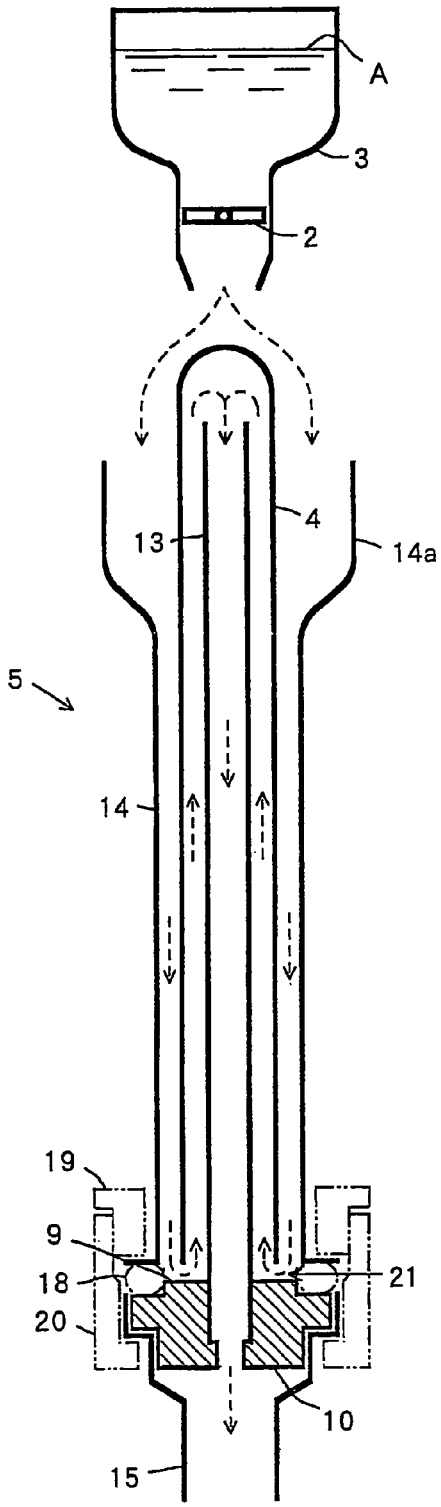
FIG. 6 is a view explaining circulation of washing liquid.

As shown also in FIG. 5, a communicating groove 21 for communicating an exterior and an interior of the sample tube 4 is formed on the top of the disk portion 9 of the holder 10 tightly contacting the lower end of the sample tube 4 in a cross shape having a center aligning with a fitting hole 12, and the interior and the exterior of the sample tube 4 are constructed so as to be communicated through the communicating groove 21 in order to circulate the washing liquid A or air between the sample tube 4 and the receiving tube 14 in the interior of the sample tube 4 even when the sample tube 4 is kept tightly in contact with the holder 10 by suction force of the suction apparatus 8.

The embodiment is constructed as mentioned above, wherein the washing apparatus 1 is assembled by fitting the holder 10 to the engaging shoulder portion 15*a* of the upper side of the siphon tube 15, fitting the O-ring 18 in the O-ring groove 17 of the holder 10, inserting the suction tube 13 into the fitting hole 12 of the holder 10, positioning the receiving tube 14 in alignment with the siphon tube 15 through the O-ring 18 from the upper side of this, and fixing the upper receiving tube 14 and lower siphon tube 15 with the connectors 19 and 20.

Assembly of the washing apparatus 1 is finished by installing the rubber plug 16 to the lower end of the siphon tube 15 and fitting the rubber plug 16 to the discharged liquid container 6, and hereafter washing can be started by a simple operation where the specified sample tube 4 is placed over the suction tube 13. For example, when using a sample tube 4 having length of 180 mm, an outside diameter of approximately 6 mm, and wall thickness of approximately 0.3 mm, the sample tube 4 and the suction tube 13 are assembled to the holder 10 through a suction tube 13 having an outside diameter of approximately 3 mm and a receiving tube 14 having an inside diameter of approximately 15 mm so as to form a clearance of approximately 1 to 8 mm between the bottom 4*a* of the sample tube 4 and the suction tube 13.

When the cock 2 of the supplying container 3 above the sample tube 4 is opened to supply washing liquid A (approximately 50 cc) such as water, alcohol, or acetone in the container 3 to the receiving tube 14, the washing liquid A in the receiving tube 14 flows into the interior of the sample tube 4 through the communicating groove 21 by suction force generated by driving the suction apparatus 8, is sucked up till the bottom portion 4*a* above the sample tube 4, flows down from the upper end opening of the suction tube 13 to the lower end opening, and then is discharged into the container 6 through the siphon tube 15. When the washing liquid supplied from the supplying container 3 flows down from the upper side to the lower side of the receiving tube 14 by suction force of the suction apparatus 8, the exterior of the sample tube 4 is washed. When the washing liquid flows from the lower side to the upper side inside the sample tube 4, the interior of the sample tube 4 is washed.

Even after the time when the washing liquid A in the supplying container 3 is used up or when supply of the washing liquid A is stopped by the cock 2, air instead of the washing liquid A is sucked into the receiving tube 14 by continuously driving the suction apparatus 8. When air flows down from the upper side to the lower side of the receiving tube 14, the exterior of the sample tube 4 is uniformly dried. When air flows up from the lower side to the upper side of the interior of the sample tube 4 through the communicating groove 21, the interior of the sample tube 4 is uniformly dried. It is possible to efficiently conduct a series of washings consisting of washing and drying using the suction apparatus 8, such as an aspirator with extremely small suction force, to circulate the washing liquid A and air rapidly.

In said embodiment, the sample tube 4 can be easily readied to start washing by simply positioning the sample tube 4 in an upside down posture, arranging the sample tube 4 around the suction tube 13, and placing the sample tube 4 on the disk portion 9 against the holder 10 and the receiving tube 14 that are installed together with the discharged liquid container 6. During the washing, the sample tube 4 is always connected to the top of the disk portion 9 by the suction force of the suction apparatus 8. It is possible to provide excellent washing without moving the sample tube 4 or without subjecting the sample tube 4 to shock load. Thus, even a sample tube having an extremely thin wall is not damaged.

Therefore, it is not necessary to impose restrictions by pressing the top of the sample tube 4 using a cap.

A test tube large in diameter or a glass tube with both ends open can be used as the sample tube 4. In case of a glass tube with both ends open, washing is conducted with one of the end openings sealed with a cap or the like. When using a sample tube 4 having a different diameter or length, the suction tube 13 and the receiving tube 14 are replaced according to the diameter or length of this sample tube 4. Thus, it is possible to conduct appropriate washing corresponding to various types of sample tubes 4 by replacing the parts necessary for the various types of sample tubes 4.

Each part of the washing apparatus 1 can be mass-produced in a simple shape using glass, stainless steel, synthetic resin, or rubber materials at a low cost. These separate parts can be assembled into a robust structure, wherein the parts can be easily replaced when repairing or changing the sample tube 4.

As mentioned above, the washing apparatus 1 having an extremely simple structure can wash the exterior and the interior of the sample tube 4 almost simultaneously in an excellent manner using a small amount of washing liquid A and can automatically dry the exterior and the interior of the sample tube 4 almost simultaneously after the washing. The washing and drying are economically and efficiently conducted within a very short time.

The number of communicating grooves 21 and their shape may be freely selected. That is to say, a linear groove or two or more grooves can be adopted.

Figure 7:
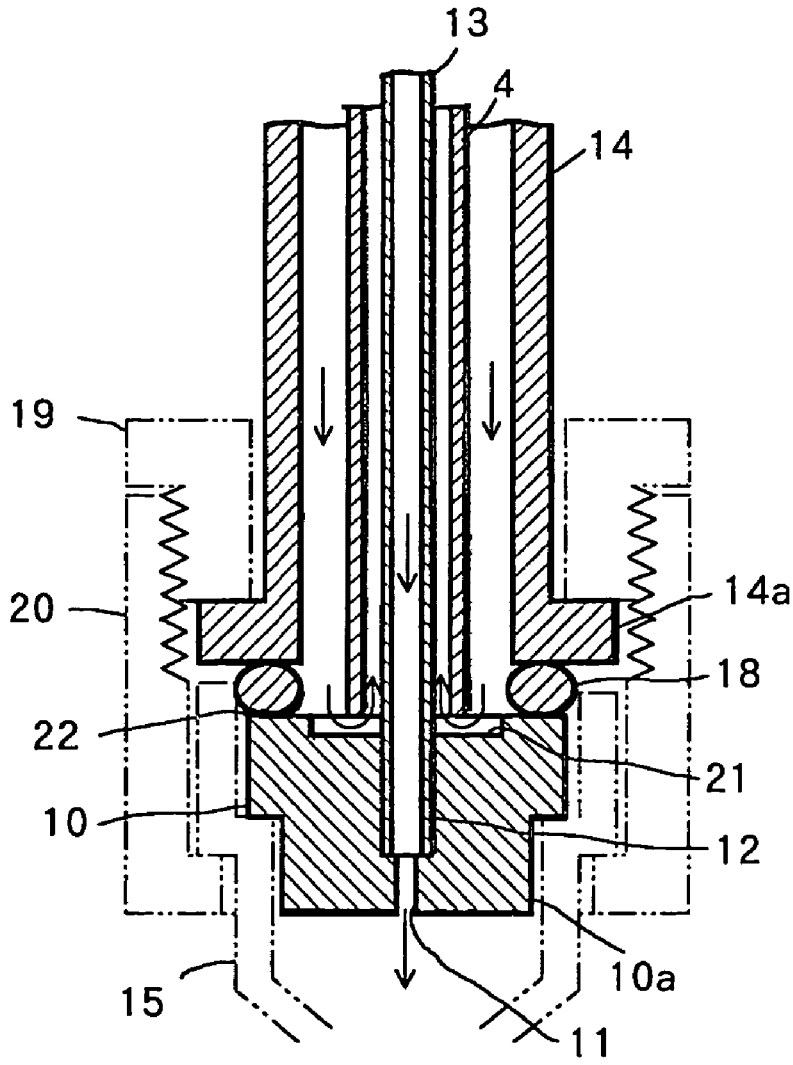
FIG. 7 is a view explaining a modified structure of the holder.
Figure 8:
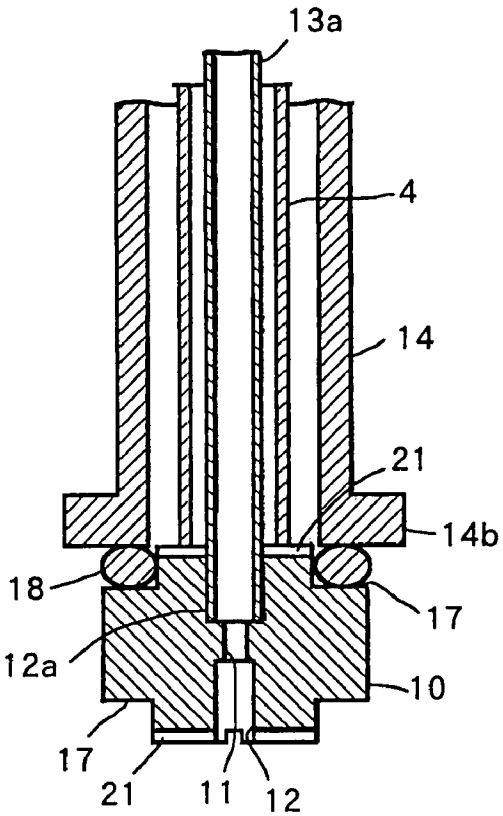
FIG. 8 is a view explaining a modified structure of the holder.
Figure 8:
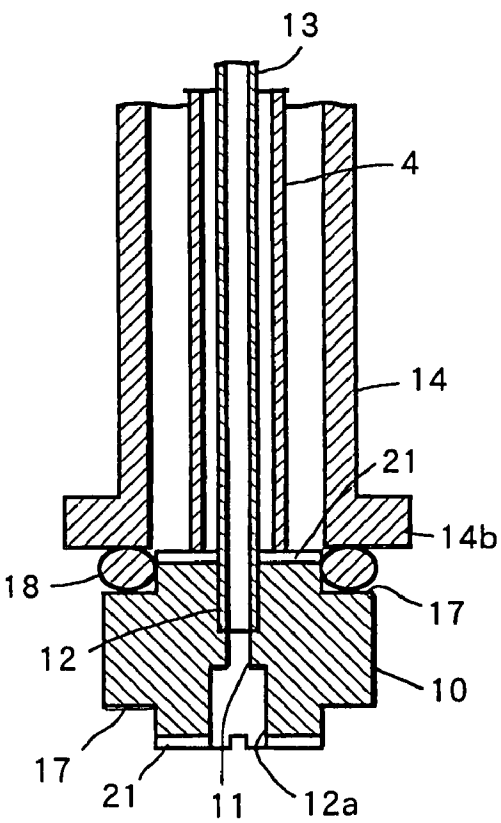

FIGS. 7 and 8 show modified structures of the holder 10. In FIG. 7, the top of the holder 10 is provided with a flat surface 22 having no disk portion 9 nor O-ring groove 17, and a communicating groove 21 longer than the outside diameter of the sample tube 4 is engraved in the flat surface 22 to produce effects similar to the aforementioned embodiment.

In the holder 10 shown in FIG. 8, upper and lower disk portions 9, O-ring grooves 17, and communicating grooves 21 are formed on the upper and lower surfaces of the holder 10, and the O-ring groove 17 in the lower position is commonly used as the external shoulder 10*a* of the holder 10 engaged with the engaging shoulder 15*a* of the siphon tube 15. Fitting holes 12 and 12*a* having a certain length of small and large diameters fitted to suction tubes 13 and 13*a* of two types, namely having small and large diameters, are formed on the upper and lower ends of the suction hole 11, and an inside diameter of the suction hole 11 is made to be smaller than those of the fitting holes 12 and 12*a*. When the holder 10 is installed to the siphon tube 15 in a manner that the small diameter fitting hole 12 is directed upward as shown in FIG. 8 (1), the small diameter suction tube 13 is inserted to and supported by the holder 10. When the holder 10 is installed to the siphon tube 15 in a manner that the large diameter fitting hole 12*a* is directed upward as shown in FIG. 8 (2), the large diameter suction tube 13*a* is inserted to and supported by the holder 10. Thus, it is possible to wash two types of the sample tube 4, namely having small and large diameters, by installing to either one of both surfaces of the single holder 10.

As clearly shown in the above embodiment, the sample tube 4 is washed by inserting the suction tube 13 from the open end of the sample tube 4 having a closed end, circulating the washing fluid A supplied from the top of the closed portion of the sample tube 4 over the exterior and in the interior of the sample tube 4, and sucking and discharging the liquid through the suction tube 13. The sample tube 4 is uniformly and completely washed with the washing liquid A circulating over the exterior and in the interior of the sample tube 4. The sample tube 4 is washed without being subjected to external pressure, thus even a sample tube having an extremely thin wall can be washed without damage in an excellent manner.

After washing the sample tube 4 with the washing liquid A, the sample tube 4 is dried by circulating air over the exterior and in the interior of the sample tube 4 through the suction tube 13. When, for example, the washing liquid A is used up, air is automatically sucked through the suction tube 13 to dry the exterior and the interior of the sample tube in an excellent and rapid manner.

The sample tube 4 is washed by providing the holder 10 for holding the sample tube 4 in a manner that the open end 4*b* of the sample tube 4 having a closed end is directed downward, the suction tube 13 of which upper end is inserted into the sample tube 4 and of which lower side is supported by the holder 10, and the washing liquid receiving tube 14 arranged around the sample tube 4, and by circulating the washing liquid A supplied from the upper side of the closed portion of the sample tube 4 over the exterior and in the interior of the sample tube 4 to suck and discharge the liquid through the suction tube 13. On the other hand, the sample tube 4 is dried by circulating air over the exterior and in the interior of the sample tube 4 through the suction tube 13 after the washing. The exterior and the interior of the sample tube 4 are washed and dried by circulating the washing liquid A and air in an excellent manner. During the washing and drying, the lower end of the sample tube 4 is sucked onto the top of the holder 10 by suction force of the suction tube 13 in order to conduct washing and drying while keeping the sample tube 4 in an appropriate position without damaging the sample tube 4.

The suction hole 11 for circulating air in the middle of the holder 10 from the upper side to the lower side is formed, the suction tube 13 and the suction hole 111 are connected communicably, and the communicating groove 21 for communicating the interior and the exterior of the sample tube 4 is provided to the top of the holder 10 that is in contact with the open end 4*b* of the sample tube 4. The sample tube 4 is securely held on the top of the holder 10 in a constant standing condition, and an appropriate amount of the washing liquid A or air flow from the exterior to the interior of the sample tube 4 through the communicating groove 21 enables washing and drying in a simple and stable manner.

The sample tube 4, the suction tube 13, the holder 10, and the receiving tube 14 are provided separately from each other. Even when, for example, the sample tube 4 is changed to one different in diameter or length, the suction tube 13, the holder 10, and the receiving tube 14 can be easily changed according to the diameter or length of the sample tube 4 to enable easy washing and drying of various types of the sample tube 4 using the single washing apparatus 1.

What is claimed is:

1. An apparatus for washing a sample tube comprising:

a holder holding a sample tube having a closed end at one end and an open end at the other end so that the open end of said sample tube is directed downward;

a suction tube having an upper end inserted into said sample tube and a lower end supported by said holder;

a receiving tube installed around said sample tube and having a flange portion at a lower end;

a siphon tube having an engaging shoulder portion, said shoulder portion engaging the holder on an inner periphery at an upper end;

an O-ring installed between the flange portion of the receiving tube and the holder; and thread-connecting upper and lower connectors pressing vertically the flange portion of the receiving tube and the siphon tube to press the O-ring between the receiving tube and the holder;

wherein a circulation pass, in which a fluid provided from above flows to an opening of the upper end of the suction tube, is formed between the sample tube and the receiving tube and between the sample tube and the suction tube; and wherein the holder, the receiving tube, the suction tube, the siphon tube, and the sample tube are separable when the upper and lower connectors are disengaged.

2. The apparatus of claim 1, further comprising a suction hole for circulating air in a middle portion of the holder from an upper side to a lower side, wherein the lower end of the suction lube fits in an upper fitting hole, the upper fitting hole having a diameter that is larger than a diameter of the suction hole in the middle portion of the holder.

* * * * *